US009212025B2

(12) United States Patent
Jakes

(10) Patent No.: US 9,212,025 B2
(45) Date of Patent: Dec. 15, 2015

(54) KIT FOR THE GUIDE OF A STAIRLIFT

(75) Inventor: John Stewart Jakes, Monaco (MC)

(73) Assignee: ACORN MOBILITY SERVICES LIMITED (GB)

( * ) Notice: Subject to any disclaimer, the term of this patent is extended or adjusted under 35 U.S.C. 154(b) by 575 days.

(21) Appl. No.: 13/511,731

(22) PCT Filed: Nov. 24, 2010

(86) PCT No.: PCT/GB2010/051961

§ 371 (c)(1),
(2), (4) Date: May 24, 2012

(87) PCT Pub. No.: WO2011/064582

PCT Pub. Date: Jun. 3, 2011

(65) Prior Publication Data

US 2012/0279826 A1 Nov. 8, 2012

(30) Foreign Application Priority Data

Nov. 24, 2009 (GB) ..... 0920567.5

(51) Int. Cl.
*B66B 21/00* (2006.01)
*B66B 9/08* (2006.01)

(52) U.S. Cl.
CPC ..... *B66B 9/0846* (2013.01); *Y10T 29/49826* (2015.01)

(58) Field of Classification Search
CPC ..... B66B 9/08; B66B 9/16; B66B 9/187; B66B 9/193; B66B 11/00; B66B 11/0005
USPC ..... 198/321, 326; 187/200, 201
See application file for complete search history.

(56) References Cited

U.S. PATENT DOCUMENTS

| | | | | |
|---|---|---|---|---|
| 3,749,202 | A * | 7/1973 | Puls | 187/201 |
| 7,225,899 | B2 * | 6/2007 | Molnar et al. | 187/201 |

FOREIGN PATENT DOCUMENTS

| | | |
|---|---|---|
| EP | 0884266 | 12/1998 |
| GB | 2 301 811 | 12/1996 |
| JP | 60 003777 | 1/1985 |
| JP | 60 061260 | 4/1985 |
| JP | 61-87001 | 5/1986 |
| JP | 61 150980 | 7/1986 |
| JP | 11278772 | 10/1999 |
| JP | 2000 128457 | 5/2000 |
| JP | 2003112877 | 4/2003 |
| JP | 2003206087 | 7/2003 |
| JP | 2008297062 | 12/2008 |
| WO | WO92/20604 | 11/1992 |

(Continued)

OTHER PUBLICATIONS

Bison 80 Stairlift Solution—dated Oct. 21, 2006.

(Continued)

*Primary Examiner* — James R Bidwell
(74) *Attorney, Agent, or Firm* — Marianne Fulerer; Moore & Van Allen, PLLC

(57) ABSTRACT

The invention provides a kit and method for the assembly of a stairlift guide rail, the kit comprising a plurality of sections of guide rail wherein the sections have predetermined standard dimensions, wherein the kit preferably includes a plurality of sections of straight guide rail and a plurality of sections of curved guide rail and when fitted together according to the method of the invention, the plurality of sections of guide rail facilitates the construction of a stairlift guide rail assembly and a stairlift assembly, such that an operative is able to complete the full assembly on site.

17 Claims, 14 Drawing Sheets

(56) References Cited

FOREIGN PATENT DOCUMENTS

| | | |
|---|---|---|
| WO | WO95/18763 | 7/1995 |
| WO | WO99/46198 | 9/1999 |
| WO | 03/004399 | 1/2003 |

OTHER PUBLICATIONS

Stairlift Brochure—dated May 7, 2004.
http://www.companiesintheuk.co.uk/lts/bison-bede—date May 1, 2013.
International Preliminary Report on Patentability issued by the European Patent Office for corresponding International Patent Application No. PCT/GB2010/0519 on Jun. 7, 2012.
www.bisonbede.com, The Stairlift Solution, Jul. 2004.
Bison Bede Ltd. Website, http://www.bisonbede.co.uk/uk/stairlifts/bison80/downloads.php—dated Apr. 22, 2013.
Bison 80 User Handbook—date Feb. 7, 2004.
Bison 80 Stairlift Solution—date Oct. 21, 2006.
Stairlift Brochure—date May 7, 2004.
http://www.companiesintheuk.co.uk/lts/bison-bede—date May 1, 2013.

* cited by examiner

Straight Section

Horizontal Bend

1st Vertical Bend

Horizontal and Vertical Bend

EXAMPLE 2

EXAMPLE 2

EXAMPLE 2

EXAMPLE 2

EXAMPLE 2

EXAMPLE 2

EXAMPLE 2

KIT FOR THE GUIDE OF A STAIRLIFT

CROSS-REFERENCE TO RELATED APPLICATIONS

This application is filed under the provisions of 35 U.S.C. §371 and claims the priority of International Patent Application No. PCT/GB2010/051961 filed on Nov. 24, 2010, which in turn claims priority to GB 0920567.5 filed on Nov. 24, 2009.

FIELD OF THE INVENTION

The present invention concerns a lift assembly. More particularly, it relates to a novel means of supplying and assembling a lift arrangement, and is especially concerned with the fitting of stairlifts.

BACKGROUND TO THE INVENTION

The use of stairlifts has become increasingly widespread in recent years as a means of overcoming problems of immobility associated with infirmity or old age which result in difficulties in climbing stairs. In larger buildings, such difficulties have long been overcome by the use of lifts or escalators but, until more recent times, no simple facilities were available which were useable in the smaller domestic environment. Consequently, the inability of certain personnel to climb or descend stairs in a safe manner without some form of assistance often proved to be a source of great inconvenience and handicap.

Therefore, stairlift devices have been developed which greatly simplify the task of ascending or descending stairs for the elderly and infirm. Generally, such devices comprise (a) load bearing means in the form of passenger carrying means, which generally comprises seating means, wherein a person is seated for the purpose of ascending or descending the stairs, but may simply comprise means for carrying a standing passenger, such as a platform or similar attachment, this being attached to (b) chassis means which movably interacts with (c) mounted guide means, typically in the form of a rail arrangement by which the device is attached to the stairs and floor, and which defines the distance and direction of travel of the passenger carrying means and chassis means, and (d) transporting means, which is operable to move the passenger carrying means along the guide means, and generally comprises driving means. Typically, in a simple arrangement, a chair would be mounted on a chassis, a rear attachment from which would be movably located in the mounted guide means, which would possibly be in the form of a guide rail affixed to the stairs, and the chair would be caused to ascend or descend the stairs by driving means such as an electric motor, which would propel the chair along the guide means in the desired direction.

Not surprisingly, stairlifts have been found to be of great benefit in the field of health care and mobility and have significantly improved the quality of life for many people. However, there is a large and growing market for these devices which has yet to be fully exploited. Several reasons for this relative failure have become apparent, one of these, of course, being the cost of supplying and fitting such a device.

One aspect of the fitting of stairlifts which contributes significantly to the cost is the requirement for bespoke products to be supplied for each individual circumstance. Thus, for example, in many residential buildings, a stairlift will travel along a substantially straight inclined rail, or a curved rail of fixed gradient from one level to another. However, it is also not uncommon for staircases to comprise two or more flights, often of different gradients and frequently with horizontal sections. This requires appropriate rail arrangements, often with horizontal sections, as corners are turned and level floor sections are negotiated. Indeed, a plethora of different fittings is required in order to cater for all requirements.

Thus, for a typical stairlift fitting, it is necessary that a surveyor should visit a location to measure the specific requirements, such that a CAD drawing can be produced and checked before a tailored design of rail is produced for fitting at the location. Clearly, this requirement incurs additional expense for the purchaser, which can provide a barrier to purchase. It is this issue that the present inventors have sought to address, by the provision of a modular guide rail system which facilitates the assembly of a stairlift for a specific location from a kit of parts comprising a plurality of individual sections of guide rails.

SUMMARY OF THE INVENTION

Thus, in accordance with a first aspect of the present invention, there is provided a kit for the assembly of a stairlift guide rail, said kit comprising a plurality of sections of guide rail, wherein said sections have predetermined standard dimensions.

Preferably, said plurality of sections of guide rail comprises a plurality of sections of straight guide rail and a plurality of sections of curved guide rail. Said plurality of sections of curved guide rail may either comprise horizontal curvature, so as to facilitate the negotiation of turns in a staircase, or vertical curvature, thereby facilitating the negotiation of inclines on a staircase. In addition, of course, said sections of curved guide rail may comprise both horizontal and vertical curvature, thereby facilitate the negotiation of combinations of turns and inclines on a staircase.

Said sections of curved guide rail comprise sections comprising horizontal curvature, vertical curvature, or horizontal and vertical curvature at a variety of predetermined angles, so as to facilitate the construction of stairlift guide rails capable of servicing up to 90% of staircase arrangements. Said curved guide rail sections also comprise sections of predetermined lengths for this purpose. Said sections of straight guide rail are of a variety of standard lengths and may either be cut to size or joined together, as appropriate, in order to cater for different situations.

In addition, said kits comprise a plurality of support means, which facilitate the secure attachment of the sections of guide rail to the floor, wall or staircase banister.

In accordance with a second aspect of the present invention, there is provided a stairlift guide rail assembly comprising a plurality of sections of guide rail, wherein said stairlift guide rail assembly is constructed from a kit according to the first aspect of the invention.

In accordance with a third aspect of the present invention, there is provided a stairlift assembly comprising a stairlift guide rail assembly according to the second aspect of the invention.

In accordance with a fourth aspect of the present invention, there is provided a method for the assembly of a stairlift guide rail, said method comprising:

(a) providing a kit according to the first aspect of the invention for the assembly of a stairlift guide rail ; and (b) assembling a stairlift guide rail by the fitting together of said sections of guide rail.

In practice, the stairlift guide rail assembly of the second aspect of the invention additionally comprises a load bearing means, typically in the form of seating means, in addition to chassis means and driving means to provide the operating stairlift assembly of the third aspect of the invention.

It will be appreciated that whilst the preferred use of the present invention is in the context of stairlifts, usually for transporting persons, the system has potentially wider applicability. Thus although the following description generally refers to the assembly when used for a stairlift, it will be appreciated that this is one example of many possible uses for the lift assembly.

BRIEF DESCRIPTION OF THE DRAWINGS

Embodiments of the invention are further described hereinafter with reference to the accompanying drawings, in which:

FIG. 1(*b*) provides an illustration of the design of mating components in a straight section of guide rail;

DETAILED DESCRIPTION OF THE INVENTION

Figure 2:
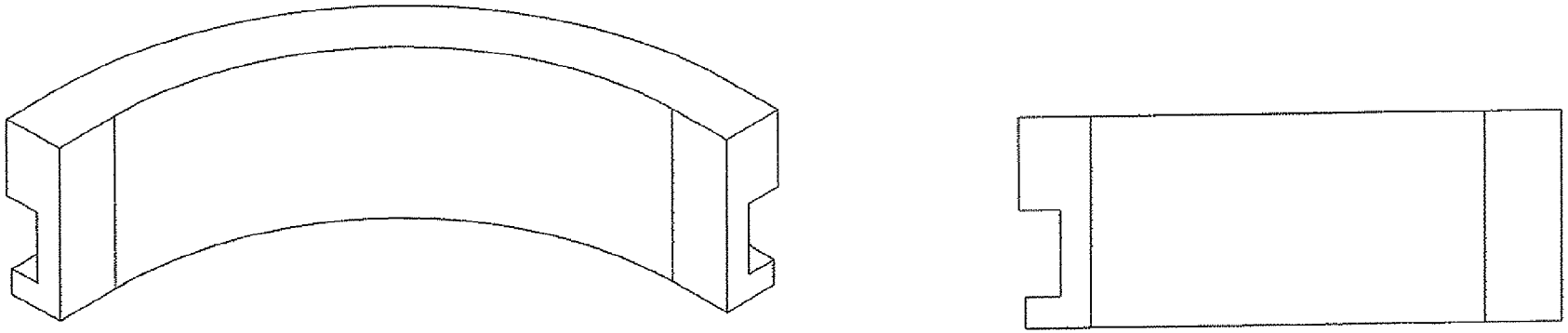
FIG. 2 provides schematic illustrations of a section of curved guide rail comprising horizontal curvature.

In its most preferred embodiment, the present invention provides a kit of between 50 and 150, preferably from 65 to 100, most preferably from 80 to 90, different standard sections of guide rail which facilitates the construction of a guide rail system for a stairlift and which facilitates the construction of stairlifts in up to 90% of staircase arrangements. Kits according to the present invention may comprise curved sections of different length comprising differing degrees of horizontal curvature and no vertical curvature, as schematically illustrated in FIG. 2. Generally, however, the kits comprise two sections having horizontal curvature and no vertical curvature, said sections each having a degree of horizontal curvature of 90°, with a first section being adapted for application on an internal bend wherein the internal side of the guide rail is adjacent a wall or stair banister and a second section being adapted for application on an external bend wherein the external side of the guide rail is adjacent a wall or stair banister.

In addition, the kits comprise at least 40 curved sections of different length comprising differing degrees of vertical curvature, and at least 10 curved sections of different length comprising differing degrees of both horizontal and vertical curvature.

Figure 1A:
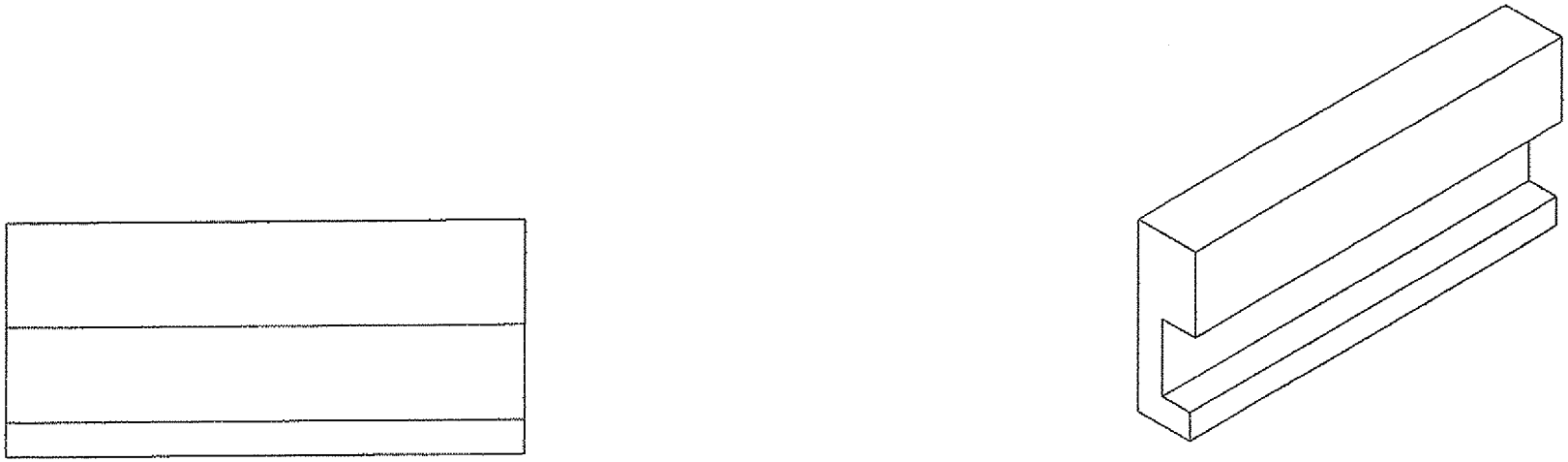
FIG. 1(*a*) provides a schematic illustration of a straight section of guide rail.
Figure 1A:
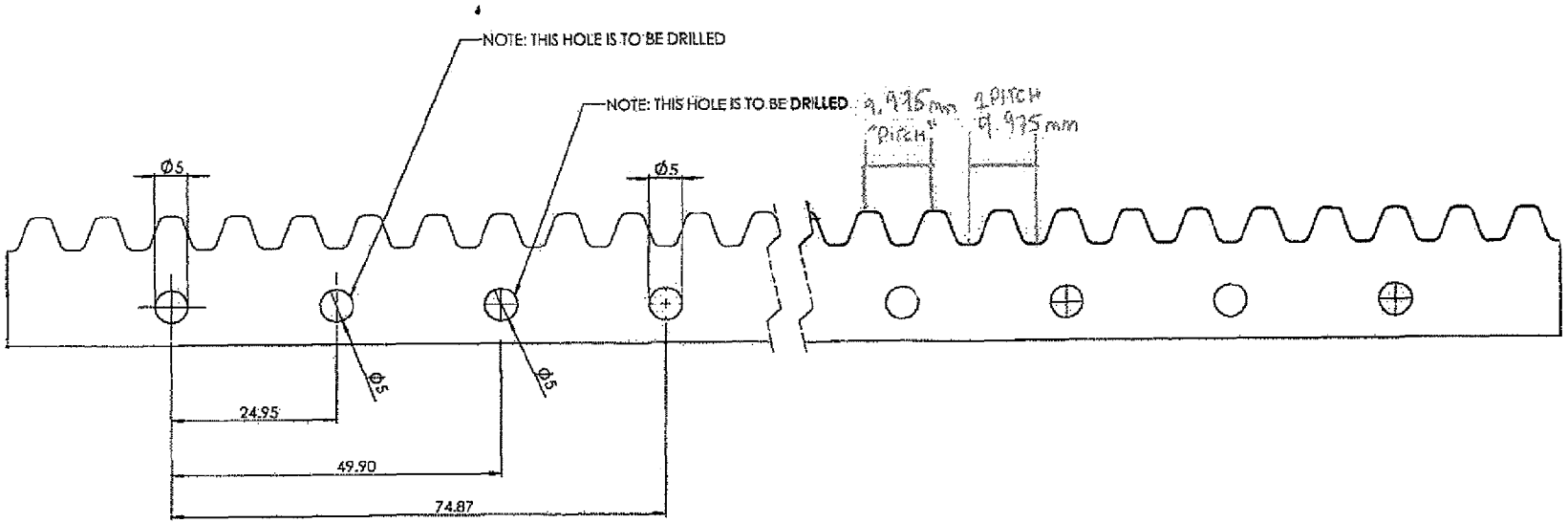

Said kits additionally comprise sections of straight guide rail, as illustrated schematically in FIG. 1, which are of different standard lengths. Alternatively, said sections of straight guide rail may be supplied in a single standard length which is simply cut to size, or fitted to additional lengths, in order to accommodate specific situations. Components of kits are provided which facilitate construction of stairlifts adapted to negotiate both right hand and left hand bends. Kits according to the invention may comprise one or more of each of said sections of rail.

Figure 3:
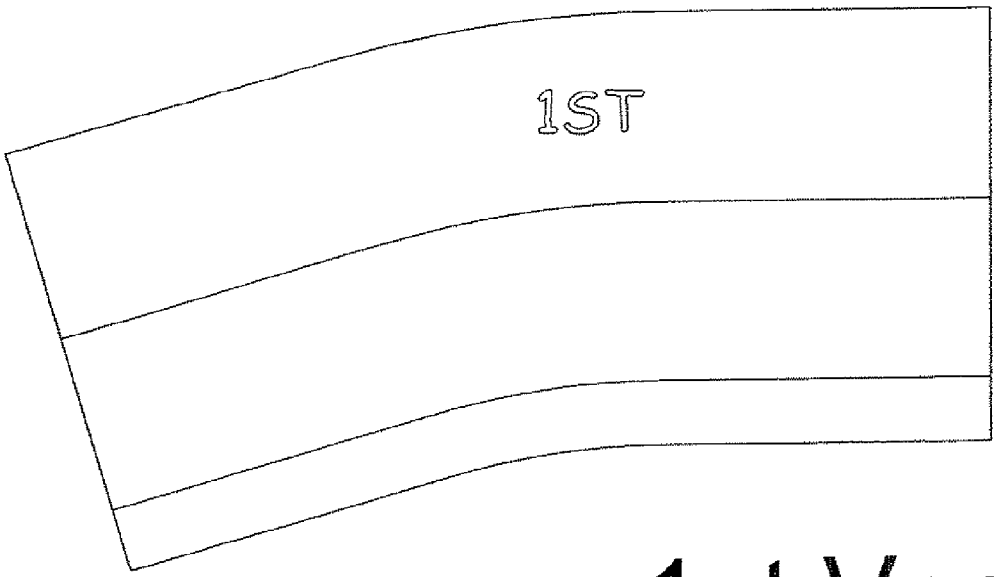
FIG. 3 provides a schematic illustration of a first section of curved guide rail comprising vertical curvature.
Figure 4:
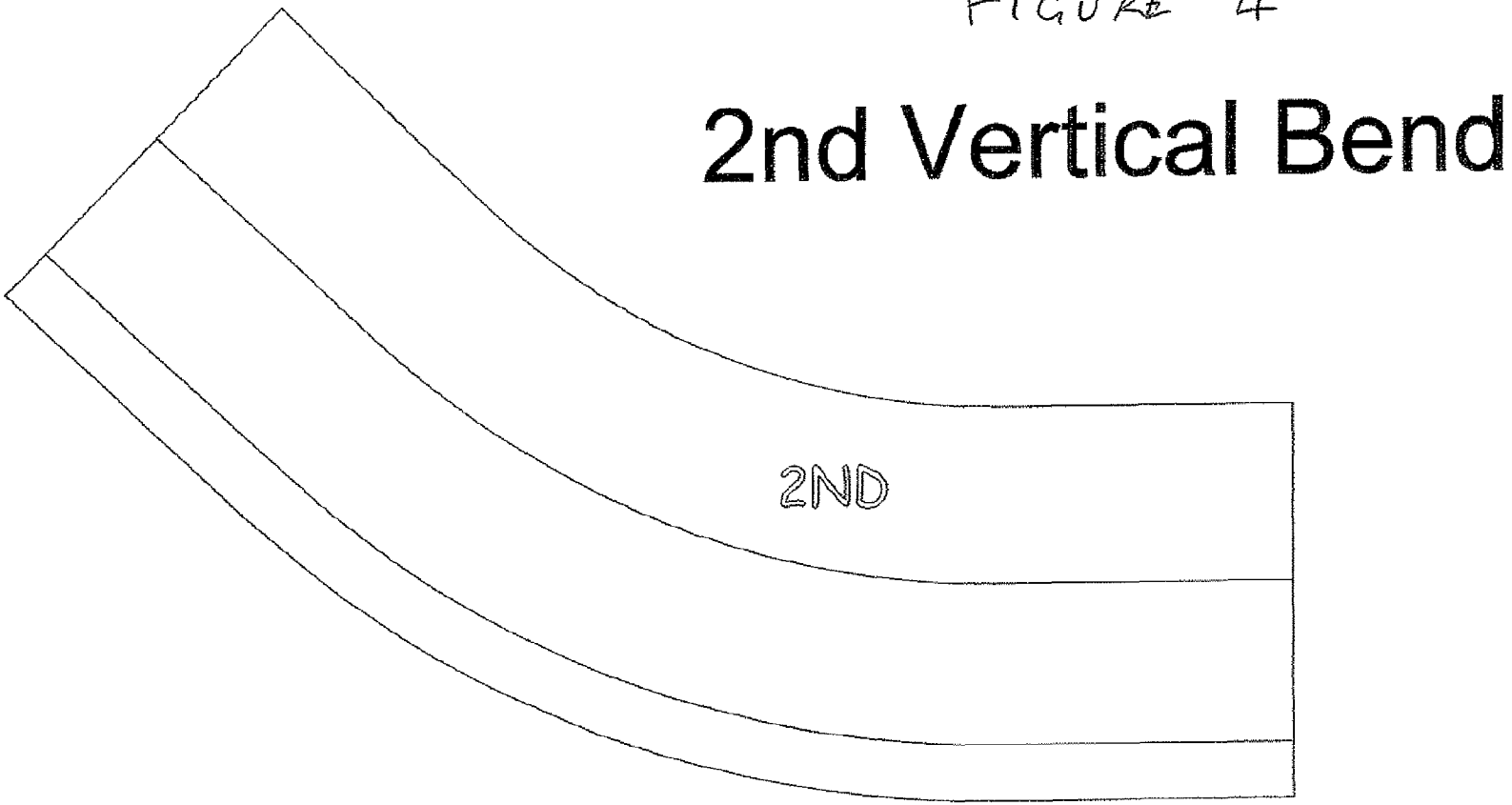
FIG. 4 provides a schematic illustration of a second section of curved guide rail comprising vertical curvature.

In particularly preferred embodiments of the invention, there are provided standard sections of guide rail having vertical curvature at a variety of different angles which are adapted, on the one hand, to negotiate decreasing gradients from the vertical to the horizontal, as illustrated in FIG. 3 and, on the other hand, to negotiate increasing gradients from the horizontal to the vertical, as shown in FIG. 4. Consequently, preferred embodiments of the invention generally provide a first set of vertical sections of guide rail having vertical curvature at a range of angles which typically range between 8° and 58°, with a tolerance of between 0.5° and 1°, and a second set of vertical sections of guide rail having vertical curvature at a range of angles which typically range between −8° and −58°, with a tolerance of between −0.5° and −1°. Generally, the kits would provide at least 20 curved sections of different length in each set, and each set would include the same number of sections.

Thus, an especially preferred arrangement would provide a first set of standard sections of guide rail which comprise vertical curvature at a range of angles between 8° and 54° with a variation of 2° between sections. Consequently, the said embodiment provides sections of rail with vertical curvature of 8°, 10°, 12°, 14°, 16°, 18°, 20°, 22°, 24°, 26°, 28°, 30°, 32°, 34°, 36°, 38°, 40°, 42°, 44°, 46°, 48°, 50°, 52° and 54° . In addition, said arrangement would provide a second set of standard sections of guide rail which comprise vertical curvature at a range of angles between −8° and −54° with a variation of −2° between sections. Consequently, the said embodiment provides sections of rail with vertical curvature of −8°, −10°, −12°, −14°, −16°, −18°, −20°, −22°, −24°, −26°, −28°, −30°, −32°, −34°, −36°, −38°, −40°, −42°, −44°, −46°, −48°, −50°, −52° and −54°.

Figure 5:
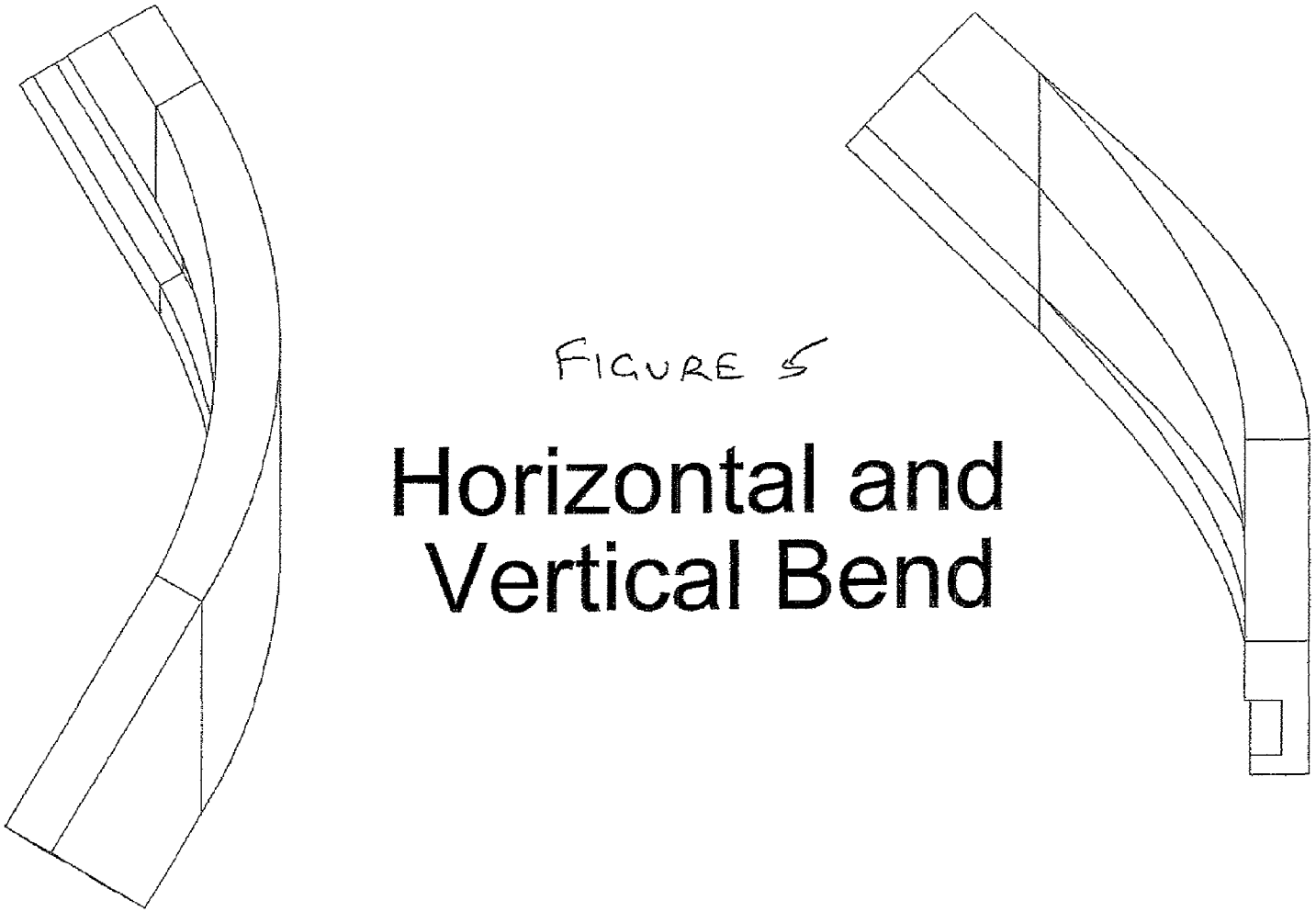
FIG. 5 provides illustrations of a section of curved guide rail comprising both horizontal and vertical curvature.

Said preferred embodiments additionally comprise standard sections of guide rail having both horizontal curvature ("rotation") and vertical curvature ("inclination") at a variety of different vertical angles which typically range between 12° and 48°, with a tolerance of between 0.5° and 1°. A schematic illustration of such a section is provided in FIG. 5. Thus, an especially preferred arrangement would provide standard sections of guide rail which comprise vertical curvature at a range of angles between 12° and 48°. Consequently, said embodiment may typically provide sections of rail with vertical curvature of 12°, 16°, 20°, 24°, 36°, 44° and 48° . In addition, said sections additionally comprise horizontal curvature at a range of angles which can vary at any angle from 5° to 180° . Thus, sections may be provided which comprise horizontal curvature at angles of 5°, 6°, 7°, 8°, etc., continuing in steps of 1° between different sections, up to 180°; most frequently, however, said angle is either 90° or 180°. Furthermore, the direction of horizontal curvature may be varied so that said sections are adapted for application on either left hand or right hand bends and, additionally, said sections may be further adapted for application on either an internal bend or an external bend.

Additionally, said embodiments comprise standard sections of straight guide rail of different lengths, wherein the length is defined in terms of the distance between two peak points or trough points of the mating components; this distance is known to those skilled in the art as the "pitch", and is illustrated in FIG. 1(*b*). A pitch is 9.975 mm and typical values for the standard sections range from 2 pitch to 300 pitch, most preferably from 5 pitch to 200 pitch, with a small variation between the shorter sections, and a larger variation between longer sections. Thus, for example, the variation between low pitch sections is typically only 1 pitch, whereas the variation between higher pitch sections may be at least 5 pitch, and may be up to 50 pitch. In an especially preferred arrangement, there are provided standard sections of guide rail of 5, 6, 7, 8, 9, 10, 11, 12, 13, 14, 20, 30, 40, 50, 100, 150 and 200 pitch. By way of illustration, therefore, the length of a 5 pitch section is 49.875 mm, whilst a 200 pitch section has a length of 1.995 m.

When assembling a guide rail system for a stairlift, an operative would visit a site and carry out the necessary measurements and assessment. From these measurements, and a knowledge of the standard components of the kit, it would be possible to select the appropriate components to construct the stairlift guide rail appropriate to the specific situation. The operative would have the stock of components, and necessary tooling, at hand and therefore be able to construct the guide rail, and fit the stairlift, on the same day as carrying out the assessment. Thus, by use of the kit according to the invention an operative is able to complete the full assembly of a guide rail and stairlift on site.

The sections of guide rail are provided with attachment means, facilitating the fitting together of sections of rail in order to construct the complete guide rail. Preferably, said attachment means comprises means incorporating screws, bolts, or the like. In addition, said attachment means facilitate the secure attachment of the guide rail, via the support means, to the floor, wall or staircase banister.

In preferred embodiments, said attachment means comprises a mating system, as illustrated in FIG. 1(*b*), comprising bolts which provides sufficient strength to withstand the loading of the guide rail, load bearing means, chassis means and transporting means, together with the weight of the user.

Optionally, said support means comprises adjustable support means, most preferably in the form of adjustable legs which comprise sub-assembly parts which facilitate guide rail height adjustment from floor or staircase for maximum flexibility, thereby allowing an operative to customise the height of the guide rail during installation. More commonly, said support means may be provided in the form of a range of adjustable legs of different lengths.

Typically, therefore, a kit according to the invention comprises a range of adjustable legs of different lengths, allowing for the maximum range of customization, and facilitating installation in a range of different situations. In a particularly suitable arrangement, the number of different sized components ranges from 2-20, but is most preferably 11. The preferred range of lengths of the legs is generally in the range of from 120-700 mm, most preferably from 125-630 mm. Generally, there will be a length difference in the region of 35-80 mm between adjacent members of the series. In an especially preferred arrangement, there is provided a series of legs having lengths of 125, 160, 220, 270, 310, 350, 395, 450, 500, 550 and 630 mm. Preferably, the vertical height of the legs may be adjusted to suit any particular situation, and the range of vertical adjustment may typically increase the leg height by an amount in the range from 30-90 mm.

In addition to the above, a kit according to the invention will additionally comprise further components such as hinges, hinge controls, and rail supports, in addition to suitable load bearing means and associated components, typically comprising suitable seating means, together with seat adaptors, seat spacers, and the like. Seat adaptors are designed to pull the seat nearer to the banister or wall by up to 40 mm, whilst the seat spacers may be employed in order to lift the seat height. Separate alternative seating means are generally provided which are adapted to operate around right hand and left hand bends, respectively.

Once the guide rail has been constructed, the load bearing means, chassis means and transporting means may be affixed thereto in order to provide a working stairlift assembly in accordance with the second aspect of the invention.

Thus, according to the present invention, it is possible to provide a working stairlift assembly which is constructed within one day, and may be constructed by the same operative who is responsible for carrying out the initial survey of the site and on the same day as the survey is performed. This offers significant advantages over the systems and methods of the prior art in terms of cost and time.

Previously it had been necessary for a surveyor to visit a site to obtain measurements, which were then provided to a drawing office for the preparation of drawings which had to be reviewed and approved before being used as the basis for manufacture of a bespoke system which then had to be transported to the relevant site, opening the possibility of errors in preparation of the order or damage being caused during shipping, before a further visit to the site by an operative in order to complete installation of the product. However, the system offered by the present invention obviates these requirements by allowing an operative to make a single visit to a site, during the course of which measurements may initially be made before installation is completed.

Consequently, the assemblies, kit and method of the present invention overcome many of the most unattractive economic obstacles involved in the installation of stairlift, and the reduced costs involved offer benefits to both the installer and the customer and present the possibility of increased availability and use of stairlifts throughout the community.

The invention will now be further illustrated, though without in any way limiting the scope thereof, by reference to the following examples and associated illustrations.

EXAMPLES

Example 1

A kit according to the invention comprises the following inventory of parts:

Bends

First Vertical Bend: 8°, 10°, 12°, 14°, 16°, 18°, 20°, 22°, 24°, 26°, 28°, 30°, 32°, 34°, 36°, 38°, 40°, 42°, 44°, 46°, 48°, 50°, 52° and 54°. These bends are of the type illustrated in FIG. 3 and are adapted to negotiate decreasing gradients.

Second Vertical Bend: −8°, −10°, −12°, −14°, −16°, −18°, −20°, −22°, −24°, −26°, −28°, −30°, −32°, −34°, −36°, −38°, −40°, −42°, −44°, −46°, −48°, −50°, −52° and −54°. These bends are of the type illustrated in FIG. 4 and are adapted to negotiate increasing gradients.

Horizontal Bend: Internal 90° and External 90°.

Helical Bend: 12 ext LH, 12 ext RH, 16 ext LH, 16 ext RH, 20 ext LH, 20 ext RH, 20 int LH, 20 int RH, 24 int LH, 24 int RH, 36 int LH, 36 int RH, 44 int LH, 44 int RH, 48 int LH, 48 int RH. The numbers relate to the degree of vertical curvature ("inclination") and sections may be provided which have various degrees of horizontal curvature ("rotation"), but will always include RH, LH, int and ext sections having 90° and 180° horizontal curvature.

Straight Sections

5 Pitch, 6 Pitch, 7 Pitch, 8 Pitch, 9 Pitch, 10 Pitch, 11 Pitch, 12 Pitch, 13 Pitch, 14 Pitch, 20 Pitch, 30 Pitch, 40 Pitch, 50 Pitch, 100 Pitch, 150 Pitch, 200 Pitch, Section A, Section B. Sections A and B are end sections cut at 45°.

Hinges

LH hinge, RH hinge

Legs 125 mm, 160 mm, 220 mm, 270 mm, 310 mm, 350 mm, 395 mm, 450 mm, 500 mm, 550 mm and 630 mm. Legs are adjustable and can each be increased in length by up to 40 mm.

Seats

Space Saver, Bison LH Carriage, Bison RH carriage.

Other Items

Kit Box Standard LH, Kit box Standard RH, Hinge Control Box, Feet/Bottom Rail Supports, RH Seat Adaptor Plate, LH Seat Adaptor Plate, RH Seat Spacer 530, RH Seat Spacer 550, LH Seat Spacer 530, LH Seat Spacer 550. The Feet and Bottom Rail Supports are fitted to the floor to support the rail, with Bottom Rail Supports being employed where Feet cannot be used.

(In the above, LH=left hand, RH=right hand, ext=external bend, int=internal bend.)

Example 2

Figure 6:
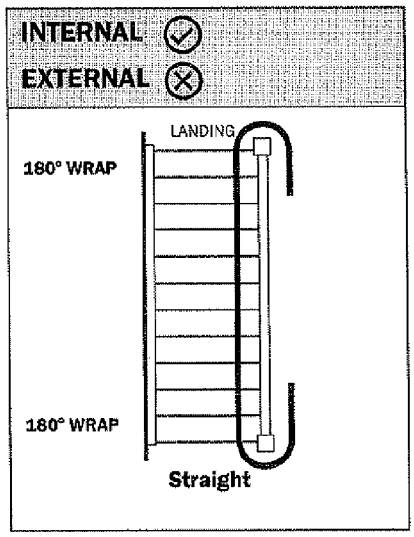
FIGS. 6-29 illustrate various fitted stairlift assemblies according to the invention which are detailed in Example 2.
Figure 7:
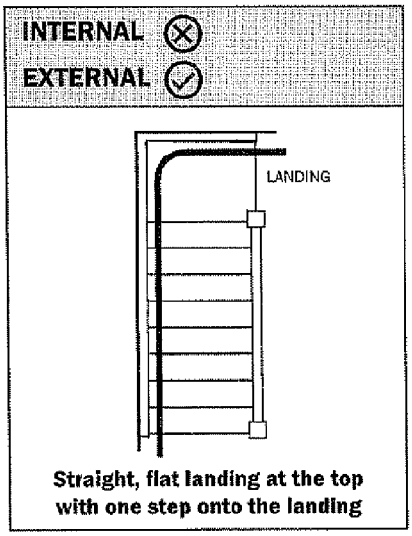
Figure 8:
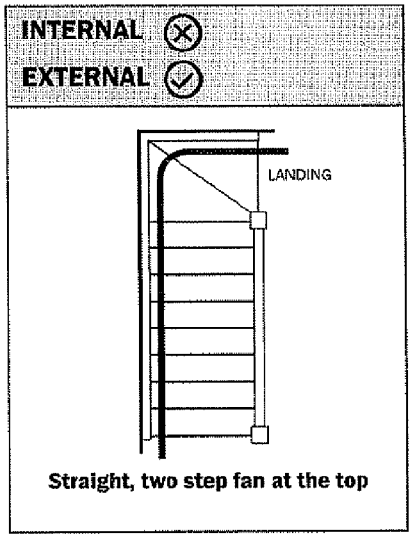
Figure 9:
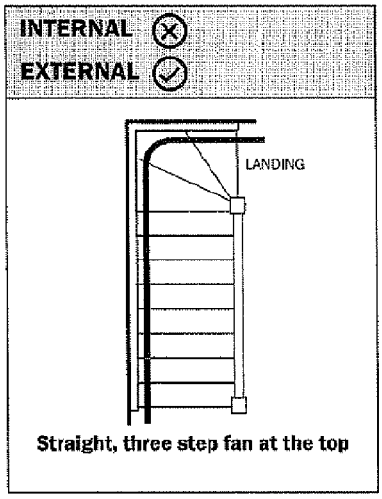
Figure 10:
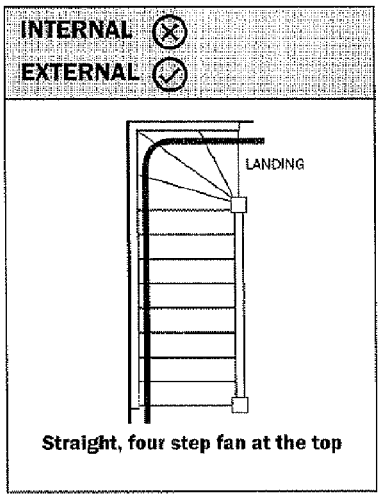
Figure 11:
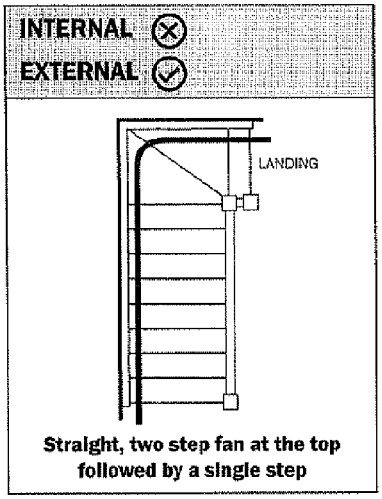
Figure 12:
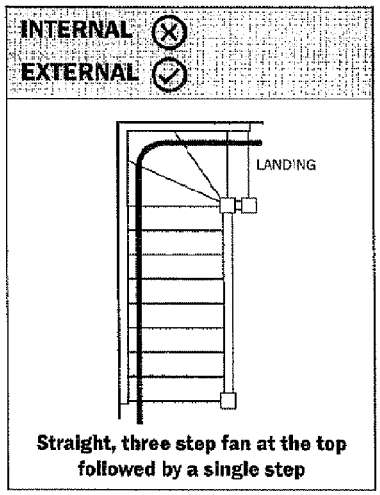
Figure 13:
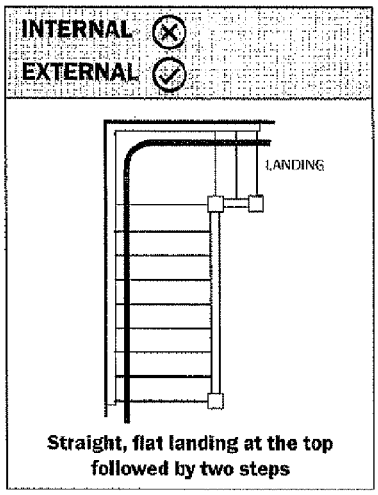
Figure 14:
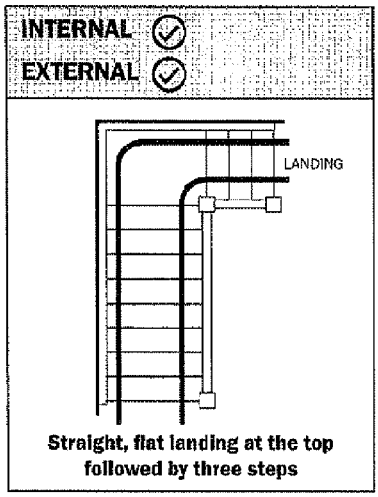
Figure 15:
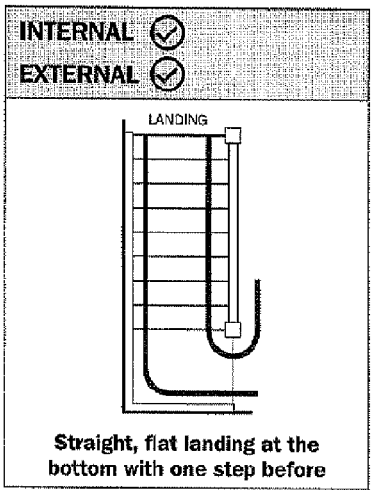
Figure 16:
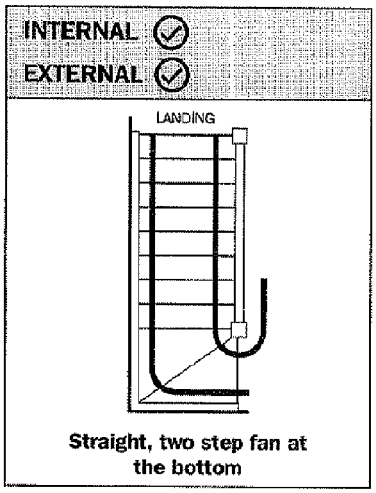
Figure 17:
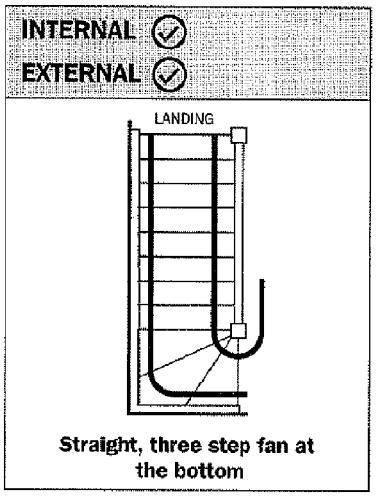
Figure 18:
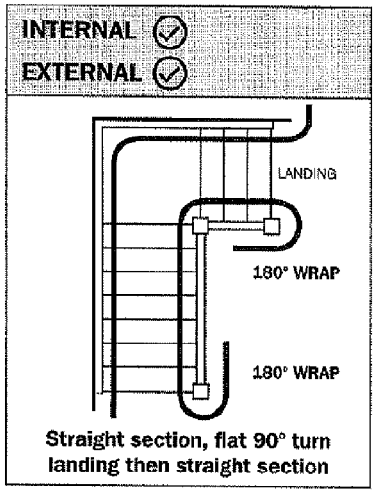
Figure 19:
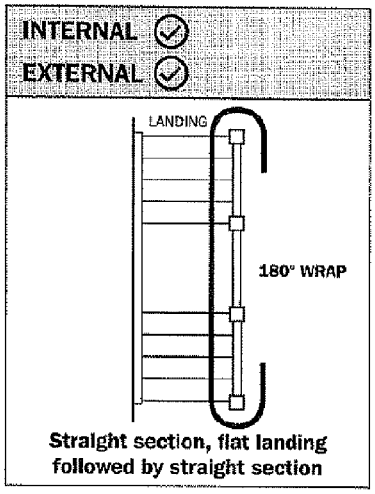
Figure 20:
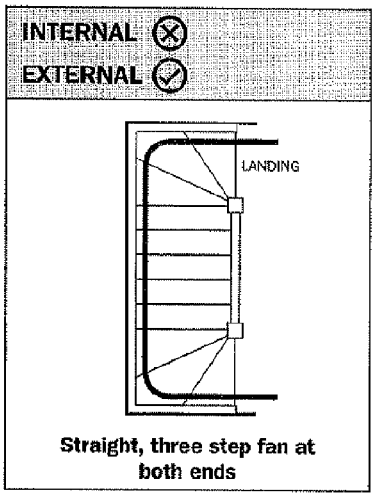
Figure 21:
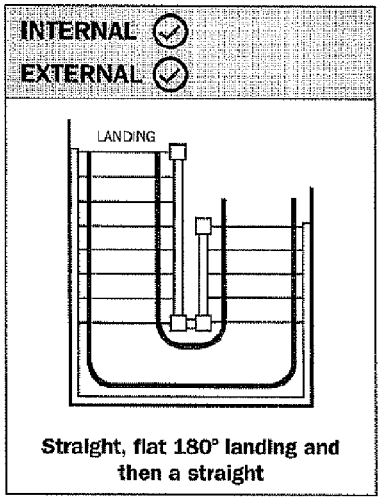
Figure 22:
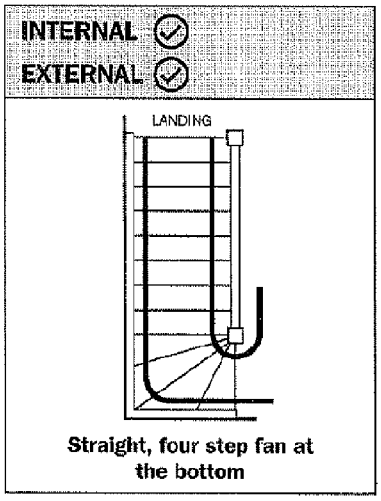
Figure 23:
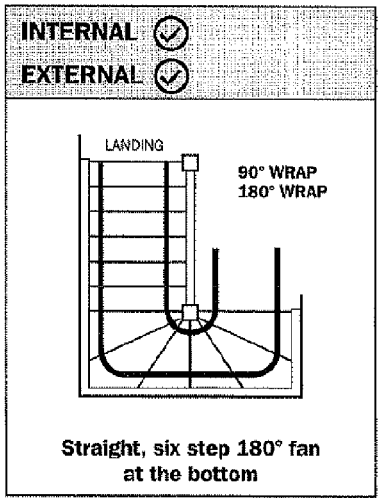
Figure 24:
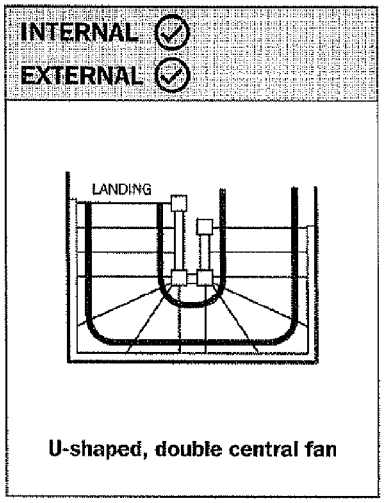
Figure 25:
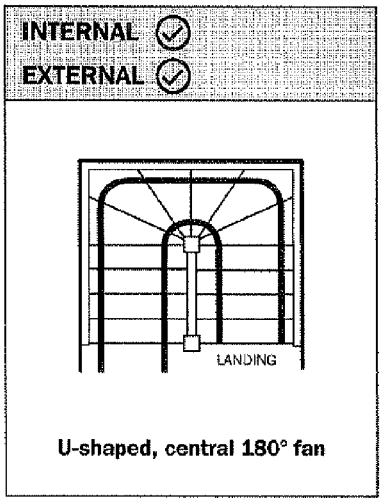
Figure 26:
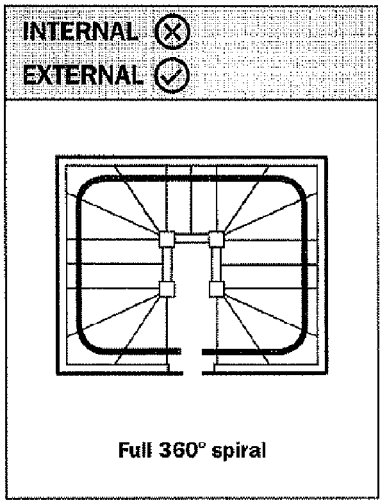
Figure 27:
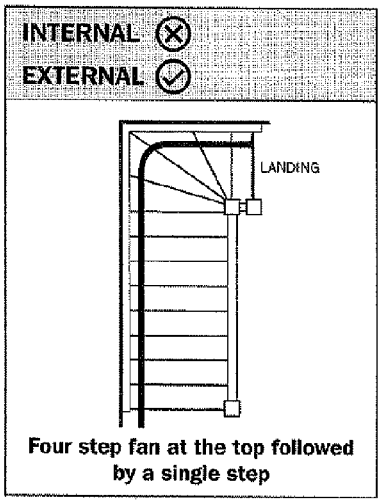
Figure 28:
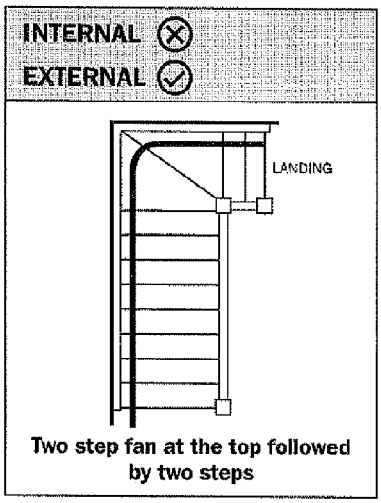
Figure 29:
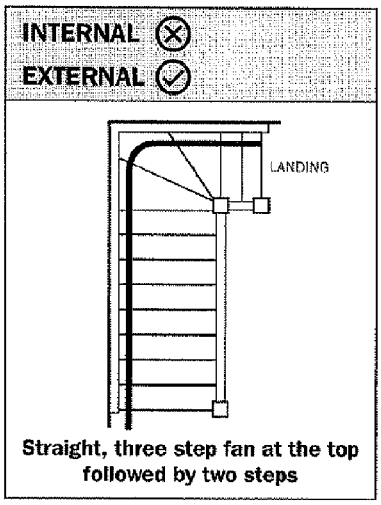

Illustrations of fitted stairlift assemblies according to the invention are provided in FIGS. 6-29 appended hereto, wherein:

FIG. 6 shows a stairlift installation on a straight staircase, and fitted round the internal bends;

FIG. 7 shows a stairlift installation on a straight staircase having a flat landing at the top with one step on to the landing, and fitted round the external bend;

FIG. 8 shows a stairlift installation on a straight staircase having a two step fan at the top, and fitted round the external bend;

FIG. 9 shows a stairlift installation on a straight staircase having a three step fan at the top, and fitted round the external bend;

FIG. 10 shows a stairlift installation on a straight staircase having a four step fan at the top, and fitted round the external bend;

FIG. 11 shows a stairlift installation on a straight staircase having a two step fan at the top followed by a single step, and fitted round the external bend;

FIG. 12 shows a stairlift installation on a straight staircase having a three step fan at the top followed by a single step, and fitted round the external bend;

FIG. 13 shows a stairlift installation on a straight staircase having a flat landing at the top followed by two steps, and fitted round the external bend;

FIG. 14 shows a stairlift installation on a straight staircase having a flat landing at the top followed by three steps, and fitted round the internal and external bends;

FIG. 15 shows a stairlift installation on a straight staircase having a flat landing at the bottom with a single step before, and fitted round the internal and external bends;

FIG. 16 shows a stairlift installation on a straight staircase having a two step fan at the bottom, and fitted round the internal and external bends;

FIG. 17 shows a stairlift installation on a straight staircase having a three step fan at the bottom, and fitted round the internal and external bends;

FIG. 18 shows a stairlift installation having a straight section, then a flat 90° turn landing, followed by a straight section, and fitted round the internal and external bends;

FIG. 19 shows a stairlift installation having a straight section, then a flat landing, followed by a straight section, and fitted round the internal bend;

FIG. 20 shows a stairlift installation on a straight staircase having three step fans at both ends, and fitted round the external bend;

FIG. 21 shows a stairlift installation having a straight section, then a flat 180° turn landing, followed by a straight section, and fitted round the internal and external bends;

FIG. 22 shows a stairlift installation on a straight staircase having a four step fan at the bottom, and fitted round the internal and external bends;

FIG. 23 shows a stairlift installation on a straight staircase having a six step 180° fan at the bottom, and fitted round the internal and external bends;

FIG. 24 shows a stairlift installation on a U-shaped staircase having a double central fan, and fitted round the internal and external bends;

FIG. 25 shows a stairlift installation on a U-shaped staircase having a central 180° fan, and fitted round the internal and external bends;

FIG. 26 shows a stairlift installation on a full 360° spiral staircase, and fitted round the external bend;

FIG. 27 shows a stairlift installation on a straight staircase having a four step fan at the top followed by a single step, and fitted round the external bend;

FIG. 28 shows a stairlift installation on a straight staircase having a two step fan at the top followed by two steps, and fitted round the external bend; and FIG. 29 shows a stairlift installation on a straight staircase having a three step fan at the top followed by two steps, and fitted round the external bend.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A kit for the assembly of a stairlift guide rail, said kit comprising a plurality of sections of guide rail, wherein said sections have predetermined standard dimensions, wherein said kit comprises a first set of sections of guide rail having vertical curvature at a variety of different angles which are adapted to negotiate decreasing gradients from the vertical to the horizontal and a second set of sections of guide rail having vertical curvature at a variety of different angles which are adapted to negotiate increasing gradients from the horizontal to the vertical, wherein said first set of vertical sections of guide rail optionally have vertical curvature at a range of angles which range between 8° and 58°, with a tolerance of between 0.5° and 1°, and said second set of vertical sections of guide rail optionally have vertical curvature at a range of angles which range between −8° and −58° , with a tolerance of between −0.5° and −1°.

2. The kit as claimed in claim 1 wherein said plurality of sections of guide rail comprises a plurality of sections of straight guide rail and a plurality of sections of curved guide rail, wherein said plurality of sections of curved guide rail optionally comprises sections comprising horizontal curvature, and sections comprising horizontal and vertical curvature at a variety of predetermined angles and wherein said plurality of sections of guide rail optionally comprises sections of predetermined lengths.

3. The kit as claimed in claim 1 which comprises from 50 to 150 different standard sections of guide rail.

4. The kit as claimed in claim 1 which comprises a single section having horizontal curvature and no vertical curvature.

5. The kit as claimed in claim 1 which comprises at least 40 curved sections of different length comprising differing degrees of vertical curvature.

6. The kit as claimed in claim 1 which comprises at least 10 curved sections of different length comprising differing degrees of both horizontal and vertical curvature.

7. The kit as claimed in claim 1 which comprises at least 20 sections curved sections of different length in each set, and wherein each set includes the same number of sections.

8. The kit as claimed in claim 1 which comprises standard sections of guide rail having both horizontal curvature and vertical curvature at a variety of different vertical angles which range between 12° and 48° , with a tolerance of between 0.5° and 1° , wherein said standard sections of guide rail optionally comprise horizontal curvature at a range of angles from 5° to 180° in steps of 1° between different sections, wherein said angle of horizontal curvature is optionally 90° or 180° and wherein the direction of said horizontal curvature is optionally varied such that said sections are adapted for application on either left hand or right hand bends.

9. The kit as claimed in claim 8 wherein said sections are further adapted for application on either an internal bend or an external bend.

10. The kit as claimed in claim 1 which comprises sections of straight guide rail of different standard lengths, wherein the length of said sections of straight guide rail optionally ranges from 2 pitch to 300 pitch.

11. The kit as claimed in claim 1 which comprises a plurality of support means, wherein said plurality of support means optionally comprises a plurality of adjustable support means which optionally comprises a plurality of adjustable legs of different lengths, wherein said plurality is optionally from 2-20 adjustable legs, wherein the range of lengths of said legs is in the range of from 120-700 mm and the vertical height of the legs may optionally be adjusted so as to increase the leg height of a leg by an amount in the range from 30-90 mm.

12. The kit as claimed in claim 1 wherein the sections of guide rail are provided with attachment means, wherein said attachment means optionally either comprises means incorporating screws or bolts or comprises a mating system comprising bolts.

13. The kit as claimed in claim 1 which comprises components selected from hinges, hinge controls, rail supports and load bearing means, wherein said load bearing means optionally comprises seating means and said kit optionally comprises components selected from seat adaptors and seat spacers.

14. A stairlift guide rail assembly comprising a plurality of sections of guide rail, wherein said stairlift guide rail assembly is constructed from a kit as claimed in claim 1.

15. The stairlift assembly comprising a stairlift guide rail assembly as claimed in claim 14.

16. The stairlift assembly as claimed in claim 15 which additionally comprises load bearing means, chassis means and driving means, wherein said load bearing means optionally comprises seating means.

17. A method for the assembly of a stairlift guide rail, said method comprising: providing a kit as claimed in claim 1 for the assembly of a stairlift guide rail; and assembling a stairlift guide rail by the fitting together of said sections of guide rail.

* * * * *